United States Patent [19]

Fong et al.

[11] 4,045,305

[45] Aug. 30, 1977

[54] CADMIUM ELECTROPLATING BATH AND PROCESS

[75] Inventors: Jaan-Jiue Fong, Tolland; Grace F. Hsu, Somers, both of Conn.

[73] Assignee: Minnesota Mining and Manufacturing Company, St. Paul, Minn.

[21] Appl. No.: 595,276

[22] Filed: July 14, 1975

[51] Int. Cl.[2] ..... C25D 3/26

[52] U.S. Cl. ..... 204/50 R

[58] Field of Search ..... 204/50 R, 114, DIG. 2, 204/43 R; 106/1

[56] References Cited

U.S. PATENT DOCUMENTS

| | | | |
|---|---|---|---|
| 2,893,934 | 7/1959 | Westbrook | 204/50 R |
| 3,826,722 | 7/1974 | Accaries et al. | 204/50 R |

FOREIGN PATENT DOCUMENTS

| | | | |
|---|---|---|---|
| 1,204,806 | 9/1970 | United Kingdom | 204/50 R |
| 184,089 | 9/1966 | U.S.S.R. | 204/50 R |

*Primary Examiner*—G. L. Kaplan

*Attorney, Agent, or Firm*—Cruzan Alexander; Donald M. Sell; Gerald F. Chernivec

[57] ABSTRACT

An aqueous acidic cadmium electroplating bath containing cadmium ion, sulfuric and/or fluoboric free acid and a surfactant comprised of a combination of a condensed naphthalene sulfonate and a non-ionic polyoxyalkylated compound. Preferably, the bath also contains one or more brighteners.

11 Claims, No Drawings

CADMIUM ELECTROPLATING BATH AND PROCESS

BACKGROUND OF INVENTION

A variety of electrolytic baths for electroplating cadmium of metallic substrates have been employed in the past. These baths typically utilize sulfates and cyanides as the primary electrolytes therein. Cyanide baths, while proving effective in a commercial sense, have significant objectionable features, not the least of which are toxicity of the bath components and difficulty of waste disposal due to the cyanide ion therein.

Heretofore available sulfate-based baths, while overcoming many of the objectionable features of the cyanide baths, have been found to exhibit relatively low throwing power and poor efficiency at low current densities resulting in an increase of metal in the bath upon continued bath operation. Furthermore, most of the sulfate-based baths contain such components as ammonium ions and chelating agents. Such components, because of their ability to complex with heavy metal ions, significantly increase the difficulty of eliminating heaving metals from spent baths.

A chloride-based cadmium bath which has overcome many of the problems of the sulfate baths, and has been popular commercially, is disclosed in U.S. Pat. No. 3,577,327. However, this bath also contains ammonium ions and chelating agents, e.g., ethylenediaminetetracetic acid (EDTA), nitrilotriacetic acid (NTA) and citric acid. Thus, removal of heavy metals from spent baths is similarly difficult and expensive waste treatment procedures and equipment must be utilized.

In U.S. Pat. No. 3,826,722 there is disclosed an acid cadmium sulfate bath which does not contain ammonium ions or chelating agents therein. However, the effectiveness of the bath is dependent upon the inclusion of a thiosemicarbazone constituent. It is believed that this compound is somewhat unstable in strong acid solutions, and upon continued use in an electrolytic bath may result in cadmium deposits which are dull in appearance over an appreciable cathode current density range. Sulfur contamination of the bath from breakdown of this thiosemicarbazone compound on extended use can also prevent bright-dipping of the work piece subsequent to cadmium deposition.

SUMMARY OF INVENTION

In accordance with the invention there is provided an aqueous acidic electrolytic bath comprising aboout 5 to about 75 grams per liter of cadmium ion, a free acid selected from the group consisting of sulfuric and fluoboric acids or mixtures thereof at a concentration of from about 4.0N to aboout 4.0N, a surfactant combination comprising about 0.5 to about 10.0 grams per liter of a condensed napthalene sulfonate compound, and from about 1.0 to about 20.0 grams per liter of a nonionic polyoxyalkylated surfactant. Preferably, the bath also contains from about 0.05 to about 2.0 grams per liter of one or more non-sulfur containing brighteners.

The present eliminates the necessity for objectionable ammonium ion and chelating agents thereby simplify waste treatment procedures for heavy metal removal. Utilization of the preferred components in the invention provides a bath exhibiting high cathode current efficiency and superior bright throwing power in recessed areas of the cathode. The bath is capable of producing bright, smooth, fine-grained cadmium deposits over a wide cathode current density range upon continued electrolysis.

DESCRIPTION OF THE PREFERRED EMBODIMENTS

As previously noted, the components which are essential for satisfactory operation of the baths of the present invention to provide smooth, fine-grained, relatively bright cadmium deposits include cadmium ions, a free acid, and the surfactant combination.

The bath may contain from about 5 to about 75 grams per liter of cadmium ion, and preferably contains about 8 to about 55 grams per liter. Cadmium ion concentrations higher than about 75 grams per liter may tend to produce a coarse, grainy and spongy deposit at low cathode current densities whereas baths containing less than about 5 grams of cadmium ion per liter result in hazy, non-uniform, non-bright deposits and exhibit low cathode current efficiency. The cadmium ion can be conveniently furnished from soluble cadmium sulfate, cadmium fluoborate salts or from cadmium oxide, the latter being capable of forming a soluble cadmium salt in combination with anions normally otherwise introduced.

The concentration of free acid selected from the group consisting of sulfuric fluoboric or mixtures thereof, may range from about 0.4N to about 4.0N, with from about 0.75N to about 2.5N being preferred. Use of less than 0.4N acid concentration may produce a poorly conductive bath which is operative only over a narrow range of current density thereby producing deposits of somewhat marginal quality. Raising the free acid concentration beyond about 4.0N provides minimal additional increase in current density and at the same time may tend to provide reduced cathode current efficiency.

The surfactant or wetting agent combination contains as a primary surfactant condensates of alkylated naphthalene sulfonic acid, either as the sulfonic acid itself or the alkali metal salt thereof. The sulfonic acid condensates should be present in a concentration of from about 0.5 grams per liter to about 10 grams per liter with from about 2.0 grams per liter to about 5.0 grams per liter being preferred. At concentrations of less than about 0.5 gram per liter, a coarse, non-uniform deposit is likely to be obtained while concentrations greater than about 10.0 grams per liter provide minimal increase in benefit for the expense incurred.

The naphthalene sulfonates are formed from naphthalene and sulfonic acid, usually condensed in the presence of a lower aldehyde such as formaldehyde and their molecular weight may vary considerably. The most useful compounds are those having a molecular weight of from about 400 to about 1,200 with from 600 to 900 being preferred.

Exemplary compounds within this class, and commercially available, include "Lomar" NCO, tradename for the sodium salt of naphthalene sulfonic acid available from the Napco Division of Diamond Shamrock Checmical Company; "Daxad" 11, tradename for a condensed naphthalene sulfonic acid available from the W. R. Grace & Company; "Blanco," tradename for a condensed naphthalene sulfonic acid available from the GAF Corporation; and Darvan No. 1, tradename for a condensed naphthalene sulfonic acid available from the R. T. Vanderbuilt Company.

The cooperating or secondary surfactant used with the above condensate may be any one of a wide variety of non-ionic polyoxyalkylated surface active compounds which are soluble in the bath. These include, but are not limited to, alkoxylated alcohols, e.g., tridecyl alcohol; alkoxylated carboxylic acids, e.g., oleic acid; alkoxylated alkyl phenols, e.g., nonyl phenol; alkoxylated amides, e.g., amide of coconut fatty acid; or alkoxylated esters, e.g., sorbitan monopalmitate; and are commercially available under a number of different tradenames. Compounds which have been found to perform particularly effectively are the polyethoxylated fatty acid monoalkanolamides and the polyethoxylated alkyl phenols. Exemplary alkoxylated compounds within the above group include: Amidox C-5, tradename for a polyethoxylated coconut acid monoethanolamide, available from the Stephan Chemical Company; Neutronyx 640, tradename for an ethoxylated nonyl phenol available from the Millmaster Onyx Corporation; Brij 98, tradename for an ethoxylated oleyl alcohol available from ICI America, Inc.; Ethofat 0/20, tradename for an ethoxylated oleic acid available from the Armak Company; Renex 36, tradename for an ethoxylated tridecyl alcohol available from ICI America, Inc.; and Tween 40, tradename for an ethoxylated sorbitan palmitate available from ICI America, Inc. Substitution of similar materials is contemplated and encompassed within the scope of the invention herein and specific alternative non-ionic polyoxyalkylated surfactants will be apparent to those skilled in the art in view of the foregoing disclosure.

The concentration of the cooperating polyoxyalkylated surfactant should be from about 1.0 gram per liter to about 20 grams per liter with from about 3.0 grams per liter to about 10.0 grams per liter being preferred. At concentrations below about 1.0 gram per liter, coarse, non-uniform deposits are obtained while concentrations greater than about 20 grams per liter may tend to provide hazy deposits and, additionally, the compound may tend to separate out of the bath due to solubility limitations.

This surfactant combination not only provides more than semi-bright cadmium deposits at low current density areas, but also increases cathode current efficiency at high current density areas, e.g., above about 3.0 amperes per square decimeter and provides good throwing and covering powers. Elimination of the naphthalene sulfonic acid condensate in the surfactant combination may provide a uniform, bright (but not fully bright), deposit, However, thin plating occurs, cathode current efficiency is reduced, and at low current densities, i.e., below about 3.0 ampere per square decimeter, sufficient polarization of the bath may occur to inhibit deposition of cadmium on the cathode.

The electrolytic bath of the present invention desirably and preferably includes non-sulfur containing organic brighteners to develop uniform specular brightness over a wide plating current density range. Brighteners which have been found to impart beneficial effects to the bath of the present invention include aryl aldehydes, e.g., anisic aldehyde; ring-halogenated aryl aldehydes, e.g., orthochlorobenzaldehyde, 2,4-dichlorobenzaldehyde and 2,6-dichlorobenzaldehyde; heterocyclic aldehydes, e.g., thiophene aldehyde; aryl olefinic-conjugated ketones, e.g., benzylidine acetone and heterocyclic carboxylic acids, e.g., nicotinic acid and isonicotinic acid. It has been determined that a combination or condensate of aminoguanidine bicarbonate and an aryl aldehyde can be utilized as a brightener herein. Aryl aldehydes such as ethyl vanillin, veratraldehyde, 2,5-dimethoxyl aldehyde, glutaraldehyde, tolyl aldehyde, etc., when admixed with aminoguanidine bicarbonate in the bath or when condensated therewith prior to addition to the bath impart full brightness to the cadmium deposit over a useful cathode current density range. Benzoylpyridine is another compound capable of use as a brightener herein.

The preferred brighteners are orthochlorobenzaldehyde, 2,4-dichlorobenzaldehyde and nicotinic acid. The brighteners may be employed singly or in combination within the concentration range of from about 0.05 gram per liter to about 2.0 grams per liter, and preferably from 0.1 gram per liter to about 1.0 grams per liter.

Bath temperatures generally range from about 15° C to about 35° C with an optimum temperature being dependent on the type of plating being undertaken. At higher temperatures, the cathode current efficiency is good, but somewhat dull deposits may be produced as the bright throwing power is reduced. Lower temperatures, below about 15° C, tend to reduce cathode current efficiency.

The invention will now be further exemplified by the following non-limiting specific examples of electrolytic solutions which may be used to accomplish the objectives of this invention. Unless otherwise specified, all parts are by weight and a standard 267 ml Hull Cell was utilized at bath temperatures of from 22° C to 24° C without agitation and utilizing a 3-ampere cathode current for 3 minutes.

EXAMPLE 1

A bath was prepared containing 30 grams per liter of cadmium oxide, 80 ml per liter of 66° Baume sulfuric acid, 4 grams per liter of Amidox C-5 and 2.4 grams per liter of Lomar NCO. A more than semi-bright cadmium deposit was produced at current densities up to about 1.8 amperes per square decimeter. Above that level, and up to about 7.5 amperes per square decimeter, the cadmium deposit was dull semi-bright and had a slightly yellowish tint to it.

EXAMPLE 2

An aqueous bath was prepared as per Example 1, but including 0.6 gram per liter of orthochlorobenzaldehyde. A bright cadmium deposit was produced on the Hull panel at current densities ranging from 0.01 to 9.0 amperes per square decimeter with the deposit having a slight yellowish tint at current densities above 4.0 amperes per square decimeter.

EXAMPLE 3

A bath was prepared as per Example 2 with the exception that Neutronyx 640 was substituted for the Amidox C-5. A bright cadmium deposit was produced at current densities of from 0.1 to 5.0 amperes per square decimeter.

EXAMPLE 4

A bath was prepared as per Example 2 with the exception that 0.3 grams per liter of nicotinic acid was substituted for the orthochlorobenzaldehyde brightener. A bright cadmium deposit was produced on the Hull panel at current densities of from 0.15 to 7.5 amperes per square decimeter, the deposit having a slightly yellowish tint.

EXAMPLE 5

A bath was prepared as per Example 2 with the exception that the brightener consisted of 0.3 gram per liter of orthochlorobenzaldehyde and 0.3 gram per liter nicotinic acid. A bright cadmium deposit was produced at current densities ranging from 0.1 to 9.0 amperes per square decimeter.

EXAMPLE 6

An aqueous bath was prepared containing 30 grams per liter of cadmium oxide, 180 milliliters per liter of fluoboric acid (47 percent by weight aqueous solution), 4 grams per liter of Amidox C-5, 2.4 grams per liter of Lomar NCO, 0.3 gram per liter of orthochlorobenzaldehyde and 0.3 gram per liter of nicotinic acid. A bright cadmium deposit was produced on the panel at current densities of from 0.5 to 12.0 amperes per square decimeter.

It has been determined that in addition to the naphthalene sulfonic acid and non-ionic surfactant combination required herein, up to about 10.0 grams per liter of a surfactant of a cationic nature, such as a polyoxyalkylated amine, can be added to the bath of the present invention without detrimental effect on the operability of the bath of which the following examples are illustrative.

EXAMPLE 7

An aqueous bath was prepared containing 14 grams per liter of cadmium sulfate, 1 percent by volume of 66° Baume sulfuric acid, 8.1 grams per liter of Tetronic 504, tradename for an ethoxylated/propoxylated ethylene diamine, 3 grams per liter of Lomar NCO, 1.3 grams per liter of Amidox C-5 and 0.56 gram per liter of orthochlorobenzaldehyde. A 1-ampere panel was run for 6 minutes, a 2-ampere panel for 5 minutes and a 3-ampere panel for 5 minutes. Bright cadmium deposits were produced on each of the 3 test panels at current densities of 0.1 to 2.5 amperes per square decimeter.

EXAMPLE 8

A bath was prepared as per Example 7 containing 97 grams per liter of cadmium sulfate, 6 percent by volume of 66° Baume sulfuric acid, 8.1 grams per liter of Tetronic 504, 3 grams per liter of Lomar NCO, 1.3 grams per liter of Amidox C-5 and 0.56 gram per liter of orthochlorobenzaldehyde. A 1-ampere panel was run for 6 minutes in the bath whereupon a bright cadmium deposit was obtained at a current density range of from 1.5 to 4.0 amperes per square decimeter.

EXAMPLE 9

An aqueous bath was prepared containing 55 grams per liter cadmium sulfate, 6 percent by volume of 66° Baume sulfuric acid, 8.1 grams per liter of Tetronic 504, 3.0 grams per liter of Lomar NCO, 1.3 grams per liter of Amidox C-5 and 0.56 grams per liter of orthochlorobenzaldehyde. The cathode deposit was bright at a current density range of from 0.05 to 4.0 amperes per square decimeter.

EXAMPLE 10

A bath was prepared as per Example 8 with the exception that the sulfuric acid concentration was reduced to 1 percent by volume. A bright deposit was obtained at current densities ranging from 1.5 to 4.0 amperes per square decimeter.

EXAMPLE 11

A condensate was prepared by mixing 1.4 grams of aminoguanidine bicarbonate with 1.8 grams of ethyl vanillin in 100 ml of Cellosolve and 50 ml water. To this solution was added 5 ml of 66° Baume sulfuric acid, and the solution was stirred overnight at 70° C.

An aqueous bath was prepared containing, per liter, 30 grams of cadmium oxide, 2.5 percent by volume of 66° Baume sulfuric acid, 10 percent by volume of fluoboric acid (47 percent by weight aqueous solution), 7.5 grams of Amidox C-5, 6.0 grams of Lomar NCO, and 15 ml of the condensate solution. Utilizing a 2-ampere panel for 5 minutes, a fully bright cadmium deposit was obtained at current densities of from 0.2 to 8.0 amperes per square decimeter.

EXAMPLE 12

An aqueous bath was prepared as per Example 11 with the exception that instead of a condensate being prepared, 0.45 gram per liter of ethyl vanillin and 0.32 gram per liter of aminoguanidine bicarbonate were placed directly into the bath. Utilizing a 2-ampere panel for 5 minutes, a fully bright cadmium deposit was obtained at current densities ranging from 0.2 to 8.0 amperes per square decimeter.

What is claimed is:

1. An aqueous electroplating bath for depositing cadmium consisting essentially of about 5 to about 75 grams per liter of cadmium ion, a free acid selected from the group consisting of sulfuric acid, fluoboric acid or mixtures thereof, the concentration of said free acid being from about 0.4N to about 4.0N, from about 0.05 to about 2.0 grams per liter of at least one non-sulfur containing organic brightener compound, and a surfactant combination comprising about 0.5 to about 10.0 grams per liter of a condensed naphthalene sulfonic acid or salt thereof and from about 1.0 to about 20.0 grams per liter of a non-ionic polyoxyalkylated compound.

2. The bath of claim 1 wherein said condensed naphthalene sulfonic acid or salt thereof has a molecular weight of from about 400 to about 1200.

3. The bath of claim 1 wherein said condensed naphthalene sulfonic acid or salt thereof is the sodium salt of condensed naphthalene sulfonic acid.

4. The bath of claim 1 wherein said polyoxyalkylated compound is selected from the group consisting of alkoxylated alcohols, alkoxylated carboxylic acids, alkoxylated alkyl phenols, alkoxylated amides or alkoxylated esters.

5. The bath of claim 4 wherein said alkoxylated amide is a polyethoxylated fatty acid monoalkanolamide.

6. The bath of claim 4 wherein said alkoxylated alkyl phenol is a polyethoxylated alkyl phenol.

7. The bath of claim 1 wherein said organic brightening compound is selected from the group consisting of aryl aldehydes, ring-halogenated aryl aldehydes, heterocyclic aldehydes, aryl olefinic-conjugated ketones and heterocyclic carboxylic acids.

8. The bath of claim 1 wherein said brightening compound is a mixture of aminoguanidine bicarbonate and an aryl aldehyde.

9. The bath of claim 8 wherein said aryl aldehyde is selected from the group consisting of ethyl vanillin, veratraldehyde, glutar aldehyde and tolyl aldehyde.

10. The bath of claim 1 additionally containing up to about 10.0 grams per liter of a cationic polyoxyalkylated amine.

11. A method for electroplating cadmium comprising the steps of:

a. preparing an aqueous bath consisting essentially of about 5 to about 75 grams per liter of cadmium ion, a free acid selected from the group consisting of sulfuric acid, fluoboric acid or mixtures thereof, the concentration of said free acid being from about 0.4N to about 4.0N from about 0.05 to about 2.0 grams per liter of at least one non-sulfur containing organic brightener compound, and a surfactant combination comprising about 0.5 to about 10.0 grams per liter of a condensed naphthalene sulfonic acid or salt thereof and from about 1.0 to about 20.0 grams per liter of a non-ionic polyoxyalkylated compound;

b. maintaining said bath at a temperature of from about 15° C to about 35° C;

c. immersing a work piece having a metallic surface and a cadmium anode in said bath; and d. applying a voltage across said work piece and anode to thereby cause deposition of cadmium on said metallic surface.

* * * * *